US005448930A

United States Patent [19]

Miner et al.

[11] Patent Number: 5,448,930

[45] Date of Patent: Sep. 12, 1995

[54] POWDER TOOL SOCKETS

[76] Inventors: Montie H. Miner, 2205 Robert, Granite City, Ill. 62040; Gary Sausto, 519 Wharf St. Suite 19B, Lake St. Louis, Mo. 63367

[21] Appl. No.: 208,680

[22] Filed: Mar. 11, 1994

[51] Int. Cl.[6] ..... B25B 13/46; B25B 13/06

[52] U.S. Cl. ..... 81/57.39; 81/177.85; 81/124.3

[58] Field of Search ..... 81/177.85, 124.2–124.7, 81/121.1, 54, 57.13, 57.14, 57.29, 57.3, 57.39, 60–63.2, 58, 58.3, 58.4, 59.1

[56] References Cited

U.S. PATENT DOCUMENTS

| | | | |
|---|---|---|---|
| 145,399 | 12/1873 | Colbert | 81/177.85 |
| 886,476 | 5/1908 | Burnop | 81/61 |
| 2,651,230 | 9/1953 | Waterval | 81/124.3 |
| 4,328,720 | 5/1982 | Shiel | 81/63 |
| 4,480,510 | 11/1984 | Aparicio, Jr. et al. | 81/57.39 |
| 4,602,534 | 7/1986 | Moettell | 81/177.85 |
| 4,699,029 | 10/1987 | Kelly et al. | 81/121.1 |
| 4,817,475 | 4/1989 | Kelly et al. | 81/121.1 |
| 5,048,379 | 9/1991 | Gramera et al. | 81/124.4 |
| 5,074,174 | 12/1991 | Kim | 81/185 |
| 5,101,695 | 4/1992 | Johnson | 81/124.6 |
| 5,168,781 | 12/1992 | Tenuta | 81/121.1 |
| 5,295,422 | 3/1994 | Chow | 81/177.85 |

*Primary Examiner*—D. S. Meislin

[57] ABSTRACT

The invention relates to through hole sockets for use in power driven ratchets in which a spring mounted in a slot in the ratchet drive wheel is biased into the space in the center of the drive wheel where the socket is disposed, and the socket is provided with a recess which accepts the ends of the spring holding the socket in registration with the drive wheel during powered rotation. The recess is deep enough that more than minimal force is required to urge the spring end back into the drive wheel to permit removal of the socket.

1 Claim, 2 Drawing Sheets

POWDER TOOL SOCKETS

This invention relates to power tool sockets.

Most power driven ratchets in use today employ sockets which are secured at one end about a driving post and are thus limited to driving nuts on threaded members having a finite length. These tools are limited to applications where the length of the threaded member to which the nuts are being attached does not exceed the depth of the socket. There is now pending before the Patent Office an application for Letters Patent on a reversible power driven ratchet which employs "through hole" principles wherein the driven socket is open at both ends and may be used to selectively tighten and remove threaded fasteners on threaded shafts, irrespective of the length of the shaft on which tightening is to occur. That separate patent application now pending, bears Ser. No. 07/931,768, and is entitled REVERSING THROUGH-HOLE PNEUMATIC RATCHET DRIVER.

Prior to the advent of the through hole power ratchet, sockets were connected to the ratchets by means of driving posts, over which one end of the socket was disposed. These posts were frequently provided with spring-loaded balls which were urged into depressions in the sockets to hold the socket about the post during driven rotation. With the advent of the through-hole ratchet, centrally located attaching means are no longer appropriate, and a need exists for a ratchet-to-socket retention device and retention method suitable for use in ratchet driving devices where the work area extends axially through the ratchet and the socket.

It is the object of this invention to provide a means and method for retaining a through hole socket in a reversible power driven rachet which will keep the socket snugly disposed in the socket driver during powered rotation thereof, and which will further permit ready removal of the socket for interchange with sockets of different sizes.

IN THE DRAWINGS

DESCRIPTION

Figure 1:
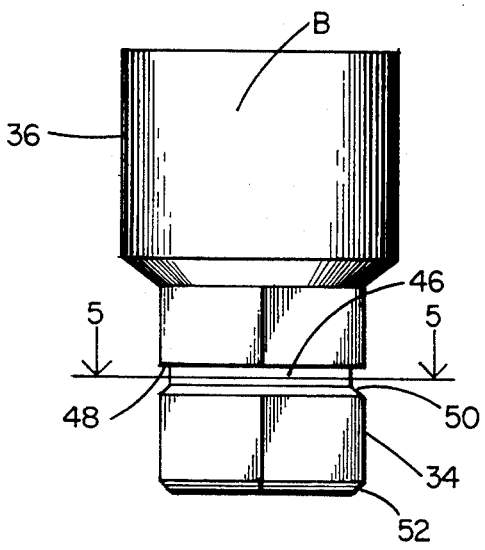
FIG. 1 is an elevational view of a preferred embodiment of our socket.
Figure 3:
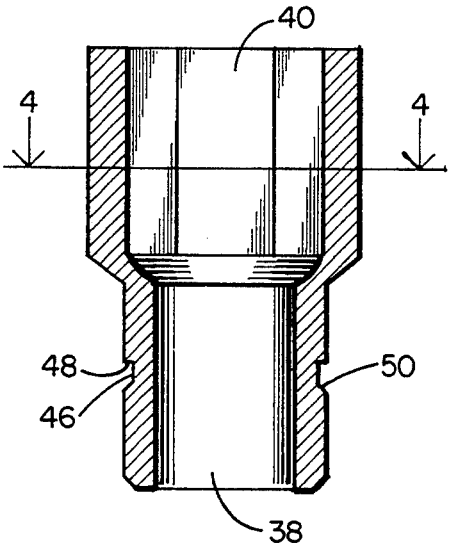
FIG. 3 is a sectional view taken along lines 3—3 of FIG. 2.
Figure 2:
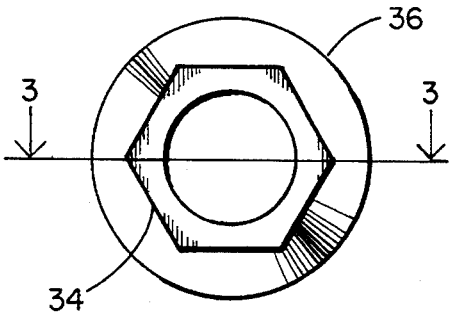
FIG. 2 is a bottom view thereof.
Figure 4:
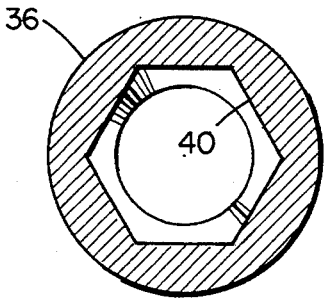
FIG. 4 is a sectional view taken along lines 4—4 of FIG. 3.
Figure 5:
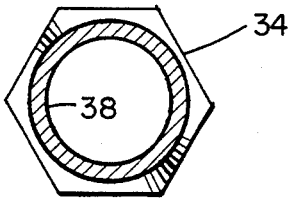
FIG. 5 is a sectional view taken along lines 5—5 of FIG. 1.
Figure 6:
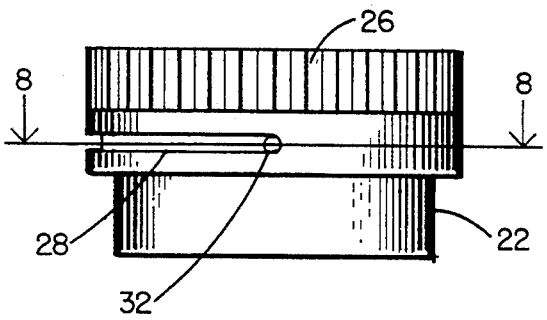
FIG. 6 is an elevational view of the socket drive gear of the ratchet to which the socket is removably attached.
Figure 7:
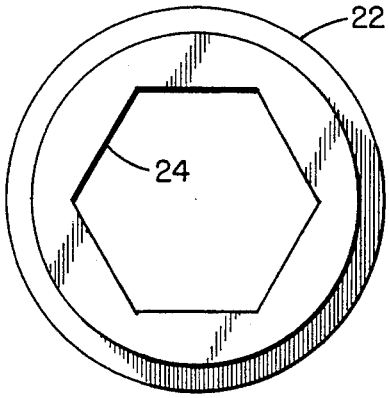
FIG. 7 is a bottom view of the socket drive gear.
Figure 8:
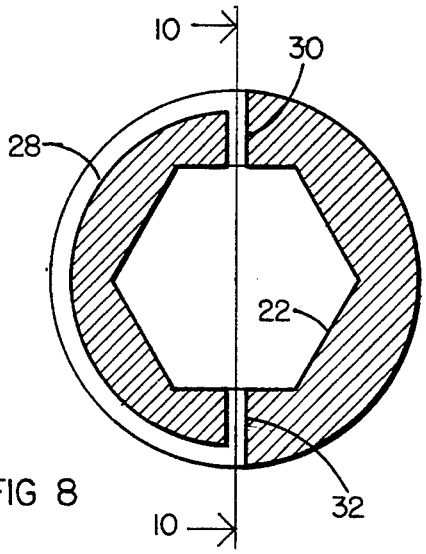
FIG. 8 is a sectional view taken along lines 8—8 of FIG. 6.
Figure 9:
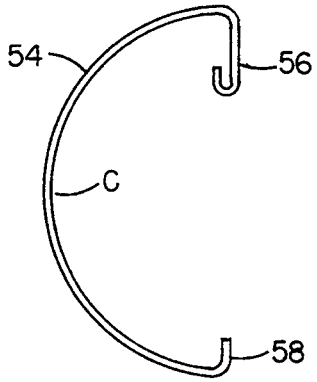
FIG. 9 is a plan view of the retaining spring.
Figure 10:
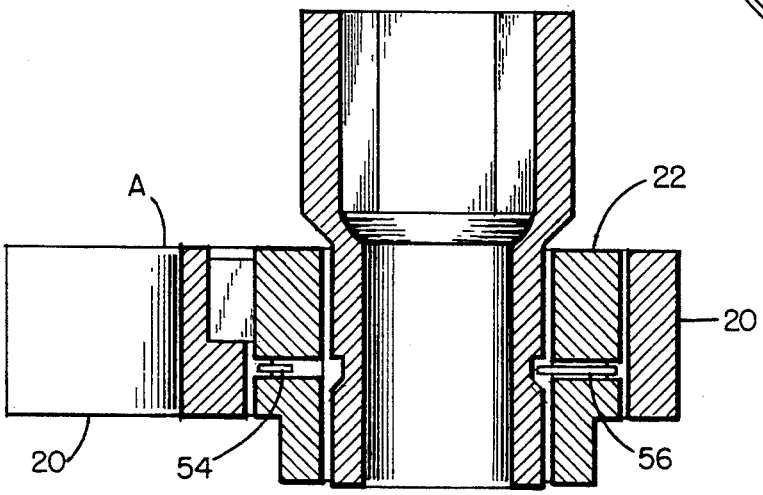
FIG. 10 is a sectional view taken along lines 10—10 of FIG. 8 (also showing a fragmentary portion of the ratchet drive yoke).

Referring now in more detail, and by reference character to the drawings illustrate a preferred embodiment of my invention, A designates a powered reversible ratchet tool comprising a driven yoke 20 in which is rotatably disposed a socket driver 22 provided with a hexagonal socket receiving aperture 24 which extends axially through the driver 22. Rotational driving forces are applied to the driver 22 through a plurality of gear teeth 26 which are disposed in a band about the outer periphery of the driver 22. Also on the outer periphery of the driver 22 and extending approximately half way therearound is a recess 28 terminated at its opposing ends with small bores 30, 32, respectively which extend radially through the driver 22 and permit access to the socket receiving aperture 24.

In the drawings, B designates an elongated socket including a hexagonal outer section 34 sized and shaped for nested disposition in the hexagonal aperture 24 and a larger annular section 36. The socket B includes an annular chamber 38 which extends axially through the socket B and a hexagonal chamber 40 which extends axially through annular section 36. The chambers 38 and 40 are in axial alignment and permit unobstructed passage of smaller objects axially through the socket B. The dimensions of the hexagonal chamber 40 have been preselected to accommodate a conventional hexagonal fastener of predetermined size (not shown), and the diameter of the annular chamber 38 has been preselected to permit free movement of the socket B axially along a threaded shaft (not shown) sized to accept the fastener. Externally, the hexagonal section 34 is provided with an peripheral notch 46 having on one side thereof a radially extending face 48 and on the opposing side a ramp-like face 50. At the end of the hexagonal section 36, the socket B is also provided with a ramp like face 52 for purposes presently more fully to appear.

Referring again to the drawings, C designates a spring comprising a central arcuate section 54 and opposing radially extending straight elements 56, 58. The arcuate section 54 is sized for nested disposition in the recess 28 with the straight elements 56, 58 disposed in and extending through the bores 30, 32 respectively, slightly into the socket receiving aperture 24. It should be here noted that the recess 28 on the socket driver 22 is sized for permitting slight radially outward movement of the straight elements 56, 58 of the spring C as the socket B is urged into the aperture 24, and that the curvature of the arcuate section 54 is such that the ends of the straight elements 56, 58 are biased to project into nested engagement with the notch 46 on opposing sides thereof when the Socket B is disposed in the aperture 24 of the socket driver 22.

USAGE

During assembly of the ratchet A, the spring C is placed in the recess 28 in such manner that the arcuate section 54 lies within the recess 28 and the straight elements 56, 58 are urged slightly into the hexagonal aperture 24 in the precise area where the notch 46 would lie when the socket B is inserted in the driver 22. The bias of the spring C urges the elements 56, 58 inwardly into the notch 46, whereby to retain the socket B in the driver 22 during powered rotation. When the operator desires to replace the socket B with a different sized socket B to accommodate a different sized threaded fastener, a slight amount of force applied in an axial direction will cause the ramp face 50 to push the spring elements 56, 58 outwardly in the recess 28 thereby permitting ready removal of the socket B. Similarly, when a second socket B is inserted the ramp end 52 of the socket B pushes the spring elements 56, 58 outwardly into the recess 28, and the socket B may be readily slid into the chamber 24.

Preferably, though not necessarily, a set of sockets B is provided for operation of the tool about threaded shafts of varying diameters, each different component of the set being provided with hexagonal chambers 40 of different sizes to accommodate the hexagonal fastener appropriate for use with the particular threaded shaft. It is to be noted, however, that the hexagonal outer shell sections 34 of each socket member B of the set remains constant, notwithstanding that the inner hexagonal chamber 40 of each member of the set may vary. When a fastener is to be driven onto a shaft, the correctly sized socket B is selected and attached to the ratchet A by urging the hexagonal section of the socket B into the hexagonal aperture 24 whereupon at a given position the ends of the straight elements 56, 58 of the spring C are disposed in the notch 46 and the socket B is held in that position in the socket driver 22 as the socket is driven. The radial face 48 of the notch 46 prevents the socket B from being inserted too far into the chamber 24; the ramp face 50 retains the spring elements 56, 58 in the notch 46 but permits forceful removal of the socket B from the ratchet A. It should also be noted that since the hexagonal faces 48 if the socket B are located on both sides of the notch 46, there is no driving torque applied to the socket B at the notch 46 and structural weakness presented to the socket B by the notch 46 has been eliminated.

It should be here noted that the operation of the ratchet with the socket B enables powered tightening of a fastener on any threaded member completely independent of the length of that member.

The sockets B may be provided in sets to accommodate threaded shafts 44 of different diameters, but under such circumstances the only dimension of each individual socket B in the set which should vary from socket to socket is the size of the hexagonal chamber 40. Changing the dimensions of the internal hexagonal chambers 42 will in no way alter or detract from the nature and operation of our invention.

It should be apparent that changes and substitutions in the unique and novel arrangement, combination, assembly and interaction of the various parts and components shown and described herein may be made without departing from the nature and principle of my invention.

Having thus described my invention, what we claim and desire to secure by Letters Patent is shown in the drawings, described in the specification and claimed in the following claims:

1. The combination of:

an annular drive wheel having a plurality of aligned gear teeth on the outer periphery thereof rotatably mounted in a power driven ratchet, said drive wheel also including an aperture which extends axially through the drive wheel along its axis of rotation, a socket comprising an elongated housing sized and shaped for snug fitting disposition in the aperture of the drive wheel, and being provided with an elongated passage, said passage having an annular inner surface along a substantial portion thereof and being shaped along the remaining portion thereof to accept a threaded fastener in snug fitting disposition therein, said annular inner surface being diametrally sized to permit free and unobstructed passage of a threaded rod about which the fastener is to be attached, and latching means for removably securing the socket within the drive wheel during powered rotation of said wheel, said latching means including a straight member disposed in the drive wheel and biased and extending into the aperture and an annular recess encircling the outer periphery of the socket and located to engage the straight member in the aperture, the latching means comprising a spring disposed in a peripheral notch on the outer surface of the drive wheel, and the straight member being an integral part of the spring which extends radially through a bore in the drive wheel into the aperture, and the recess including one annular face perpendicular to the axis of rotation and a second annular face spaced from the first face and oblique to the axis of rotation, whereby to permit ramp like movement of the spring element into and out of the recess as the socket is urged along the axis of rotation.

* * * * *